US011499351B2

(12) United States Patent
Nakamura et al.

(10) Patent No.: US 11,499,351 B2
(45) Date of Patent: Nov. 15, 2022

(54) STRIKER MOUNTING STRUCTURE

(71) Applicants: KABUSHIKI KAISHA TOYOTA JIDOSHOKKI, Kariya (JP); TOYOTA JIDOSHA KABUSHIKI KAISHA, Toyota (JP)

(72) Inventors: Shu Nakamura, Kariya (JP); Hironori Tajima, Kariya (JP); Kazuhiko Sato, Kariya (JP); Mikio Nakashima, Toyota (JP); Hiroki Kawamura, Okazaki (JP); Tsuyoshi Kato, Hekinan (JP); Satoshi Maekawa, Toyota (JP); Hirokazu Shirouzu, Tsukuba (JP); Kanichi Saito, Toyota (JP)

(73) Assignees: KABUSHIKI KAISHA TOYOTA JIDOSHOKKI, Kariya (JP); TOYOTA JIDOSHA KABUSHIKI KAISHA, Toyota (JP)

( * ) Notice: Subject to any disclaimer, the term of this patent is extended or adjusted under 35 U.S.C. 154(b) by 297 days.

(21) Appl. No.: 16/843,254

(22) Filed: Apr. 8, 2020

(65) Prior Publication Data

US 2020/0325707 A1 Oct. 15, 2020

(30) Foreign Application Priority Data

Apr. 10, 2019 (JP) ..... JP2019-074495

(51) Int. Cl.
*E05B 85/04* (2014.01)
*E05B 79/04* (2014.01)
(Continued)

(52) U.S. Cl.
CPC ..... *E05B 85/04* (2013.01); *E05B 79/02* (2013.01); *E05B 79/04* (2013.01);
(Continued)

(58) Field of Classification Search
CPC .... E05B 85/045; E05B 17/2084; E05B 85/04; E05B 79/04; E05B 79/02; Y10T 292/696;
(Continued)

(56) References Cited

U.S. PATENT DOCUMENTS 2,942,310 A * 6/1960 Whittlesey ..... E04B 1/6183 292/341.15
2,942,905 A * 6/1960 Wootton ..... E05C 19/063 248/222.12

(Continued)

FOREIGN PATENT DOCUMENTS

DE 102018007926 A1 * 2/2020
JP 2001-277854 A 10/2001

(Continued)

OTHER PUBLICATIONS

Communication dated Feb. 12, 2021, from the Japanese Patent Office in application No. 2019074495.

*Primary Examiner* — Christine M Mills
*Assistant Examiner* — Faria F Ahmad
(74) *Attorney, Agent, or Firm* — Sughrue Mion, PLLC

(57) ABSTRACT

A striker mounting structure is designed to mount a striker on a vehicle body and prevent a door from entering a passenger compartment. A reinforcement provided on the vehicle body is covered by an outer panel. A striker mounting surface is arranged to be spaced away from the reinforcement in a front/backward direction of the vehicle body. The reinforcement is provided with an insertion hole opening toward a direction away from the passenger compartment. The striker and a reinforcement member are fixed to opposite sides of the striker mounting surface. A connecting rod is fixed to the reinforcement member and is formed with a locking portion extending into the insertion hole in a direction toward the passenger compartment and formed with an abutment portion. A distance between an end of the (Continued)

abutment portion and the passenger compartment is smaller than a distance between the striker and the passenger compartment.

20 Claims, 8 Drawing Sheets

(51) Int. Cl.
*E05B 79/02* (2014.01)
*E05B 17/20* (2006.01)

(52) U.S. Cl.
CPC ..... *E05B 17/2084* (2013.01); *Y10S 292/53* (2013.01); *Y10S 292/54* (2013.01); *Y10T 292/68* (2015.04); *Y10T 292/696* (2015.04); *Y10T 292/705* (2015.04)

(58) Field of Classification Search
CPC ..... Y19T 292/696; Y19T 292/705; Y19T 292/68; Y10S 292/53; Y10S 292/54; B62D 25/04; B62D 21/157; B62D 25/025; B61J 5/0458
USPC ..... 296/146.9
See application file for complete search history.

(56) References Cited

U.S. PATENT DOCUMENTS 2,996,327 A * 8/1961 France ..... E05B 83/16 292/216
3,647,252 A * 3/1972 Nolin ..... F16B 43/02 292/357
4,470,626 A * 9/1984 Gergoe ..... E05B 85/045 292/DIG. 43
4,575,138 A * 3/1986 Nakamura ..... E05B 85/243 292/216
4,602,813 A * 7/1986 Gergoe ..... E05B 85/045 292/DIG. 43
4,756,565 A * 7/1988 Myslicki ..... E05B 85/045 292/DIG. 43
4,946,208 A * 8/1990 Myslicki ..... E05B 15/0245 292/216
4,998,759 A * 3/1991 Peterson ..... E05B 85/045 292/DIG. 53
5,209,531 A * 5/1993 Thau ..... E05B 85/045 292/216
5,711,559 A * 1/1998 Davis ..... E05B 65/0053 292/340
6,038,740 A * 3/2000 Hoger ..... E05D 7/04 16/382
6,735,822 B2 * 5/2004 Spurr ..... B60J 5/0431 16/388
7,909,372 B2 * 3/2011 Yamada ..... E05B 85/045 292/340
8,226,157 B2 * 7/2012 Mackenzie ..... B62D 25/04 296/193.06
8,371,640 B2 * 2/2013 Horneck ..... B60J 5/0458 296/187.12
10,882,561 B2 * 1/2021 Nakashima ..... B62D 25/04
2004/0093917 A1 * 5/2004 Sullivan ..... E05C 19/184 70/164
2008/0116700 A1 * 5/2008 Snyder ..... E05B 85/045 292/341.12
2008/0217932 A1 * 9/2008 Yamada ..... B60N 2/366 292/340
2009/0250947 A1 * 10/2009 Wiese ..... E05B 85/045 292/216
2010/0320778 A1 * 12/2010 Stechschulte ..... E05B 85/045 292/216
2011/0316294 A1 * 12/2011 Kim ..... B62D 25/04 292/340
2012/0112477 A1 * 5/2012 Muramatsu ..... E05B 85/045 292/342
2014/0053388 A1 * 2/2014 Mazzei ..... E05B 85/045 29/464
2019/0225276 A1 7/2019 Nakashima et al.
2020/0284071 A1 * 9/2020 Choi ..... E05B 83/40
2020/0324629 A1 * 10/2020 Nakamura ..... E05B 85/04
2021/0023923 A1 * 1/2021 Honda ..... B62D 25/04

FOREIGN PATENT DOCUMENTS

JP 2003-081137 A 3/2003
JP 2019127262 A 8/2019

* cited by examiner

STRIKER MOUNTING STRUCTURE

CROSS-REFERENCE TO RELATED APPLICATIONS

This application claims priority to Japanese patent application serial number 2019-74495, filed Apr. 10, 2019, the contents of which are incorporated herein by reference in its entirety for all purposes.

BACKGROUND

The present invention relates to a striker mounting structure.

A catcher mounting support structure (corresponding to a striker mounting structure) may be provided for vehicle doors. This mounting structure prevents a door from entering a passenger compartment in the event of a side collision with a vehicle body.

The mounting structure includes a reinforcement and a tubular member (corresponding to a connecting rod) mounted to a vehicle body. The reinforcement has, for example, substantially a box shaped cross section with a reinforcement front and a reinforcement rear. One end of the tubular member is fixed to the reinforcement front and the other end to the reinforcement rear.

The mounting structure is provided on a vehicle body side member, for example, a rear wheel arch part (corresponding to a vehicle body). A catcher (corresponding to a striker) is mounted on the tubular member by screw tightening a mounting bolt(s). This mounting structure is very resistive to input of an impact load in the event of a side collision.

The mounting structure is fixed to the rear wheel arch part. Therefore, the impact load generated in the event of a side collision is directly applied to the reinforcement via the mounting structure. As a result, the reinforcement may be easily deformed due to the impact.

SUMMARY

According to one aspect of the present embodiment, the present disclosure relates to a striker mounting structure that is configure to mount a striker on a vehicle body. A hook fixed on a door is hooked to the striker. A reinforcement formed with an insertion hole(s) may be attached to the vehicle body. An outer panel covering the reinforcement may include a striker mounting surface arranged to be spaced apart from the reinforcement. The reinforcement member may be fixed to the striker and the striker mounting surface. A connecting rod may be fixed to the reinforcement member. The connecting rod may include a locking portion configured to be inserted in an insertion hole and may include an abutment portion extending along the reinforcement member in the direction toward passenger compartment. An end of the abutment portion of the connecting rod may face an abutment surface of the reinforcement. The end of the abutment portion is disposed closer to the passenger compartment than an end of the striker closest to the passenger compartment. The locking portion of the connecting rod is inserted in the insertion hole near the end of the insertion hole closer to the side of the reinforcement member.

Therefore, when an impact is applied to a lateral side of the vehicle body, the door is deformed and the hook of the door pulls the striker. The reinforcement member and the connecting rod move together with the striker, such that the locking portion of the connecting rod strikes a hole wall surface of the insertion hole(s) of the reinforcement. Consequently, the force caused by the collision is not directly, but rather indirectly, applied to the reinforcement. Further, the abutment portion of the connecting rod is abutted to the abutment surface of the striker. Therefore, the force applied due to the collision is dispersed by the locking portion of the connecting rod and the abutment portion. As a result, the door is favorably prevented from entering in the passenger compartment direction.

According to another aspect of the present embodiment, the hook may be provided at a rear end of the door. The striker mounting surface may be located in front of the reinforcement. Therefore, the impact is reliably transmitted to the reinforcement via the striker mounting surface, when the hook of the door moves forward due to the collision with the door.

According to another aspect of the present embodiment, the insertion hole(s) may open away from the passenger compartment. The connecting rod may include a rod portion extending in a forward/backward direction of a vehicle. The locking portions may extend from the rod portion toward the inside of the passenger compartment, so as to be inserted in the insertion hole(s). Consequently, bent portions are formed between the rod and locking portions. The impact applied to the vehicle body may thus be additionally absorbed due to the deformation of the bent portions.

According to another aspect of the present embodiment, a reinforcement member is abutted to a rear surface of the striker mounting surface, the surface facing the reinforcement. The striker is abutted to a front surface, which is an opposite side of the rear surface of the striker mounting surface. The striker and the reinforcement member thus cooperate to clamp the striker mounting surface. In this way, the striker and the reinforcement member can be securely mounted to the striker mounting surface.

According to another aspect of the present embodiment, the connecting rod may include a rod portion extending in the forward/backward direction of the vehicle. The locking portion extends from a first end of the rod portion in the direction toward the passenger compartment and is inserted into the insertion hole. An abutment portion extends from a second end of the rod portion in the direction toward the passenger compartment. Therefore, a bent portion is formed between the rod portion and the locking portion. A bent portion is formed between the rod portion and the abutment portion as well. This allows the impact applied to the vehicle body to be absorbed due to the deformation of a bent portion.

According to another aspect of the present embodiment, the end of the reinforcement in the direction toward the passenger compartment may have a flange-like configuration. The reinforcement may have a cross-sectional configuration in a hat-shape. The end may include the abutment surface. The end of the flange-like configuration is joined to another member such that the strength thereof is enhanced. The abutment surface may be formed at the end. This ensures the abutment surface to reliably support the abutment portion of the connecting rod. As a result, the striker is reliably prevented from moving in the direction toward the passenger compartment.

According to another aspect of the present embodiment, the connecting rod may comprise a first connecting rod fixed to the upper part of the reinforcement member and a second connecting rod fixed to a lower part of the reinforcement member. An interval between the first connecting rod and the second connecting rod gradually reduces or increases toward the backward direction. The first connecting rod and the second connecting rod therefore effectively prevent the movement of the striker mounting structure in an upward/downward direction. The striker is thus prevented from rotating in a side view.

According to another aspect of the present embodiment, a reinforcement plate may be provided so as to extend from the reinforcement member toward the reinforcement. Therefore, the reinforcement member is reinforced by the reinforcement plate, such that the impact force can be effectively retained by the reinforcement member.

According to another aspect of the present embodiment, the connecting rod is fixed to the reinforcement plate. Thus, the reinforcement plate and the connecting rod cooperate to reinforce the reinforcement member. As a result, the impact force can be more effectively retained by the reinforcement member.

According to another aspect of the present embodiment, the connecting rod may include a first connecting rod and a second connecting rod. The first connecting rod extends along the upper edge of the reinforcement plate and is fixed to the reinforcement plate. The second connecting rod extends along the lower edge of the reinforcement plate and is fixed to the reinforcement plate. An interval between the first connecting rod and the second connecting rod gradually reduces or increases toward the backward direction.

Therefore, the first connecting rod and second connecting rod effectively prevent the striker mounting structure from moving in the upward/downward direction. Thereby, the striker is prevented from rotating in the side view. The direction of the force applied to the striker is restricted when the impact is applied to the lateral side of the vehicle body. As a result, the strength of the striker may be improved when the reinforcement plate is formed of a material having greater strength than the reinforcement member.

According to another aspect of the present embodiment, the reinforcement plate is a separate component from the reinforcement member and is attached to the reinforcement member. Therefore, the shape of the reinforcement plate can be flexibly selected and may be formed, for example, in a shape corresponding to the shape of the reinforcement.

According to another aspect of the present embodiment, the reinforcement plate may have a ridge line extending in the forward/backward direction, so as to form a convex shape in a direction away from the passenger compartment or toward the passenger compartment. Therefore, the strength of the reinforcement plate in the forward/backward direction may be greater. On the other hand, the reinforcement plate may be easily bent about the ridge lines in the upward/downward direction, so that the impact can be further absorbed by the reinforcement plate.

DETAILED DESCRIPTION

Figure 1:
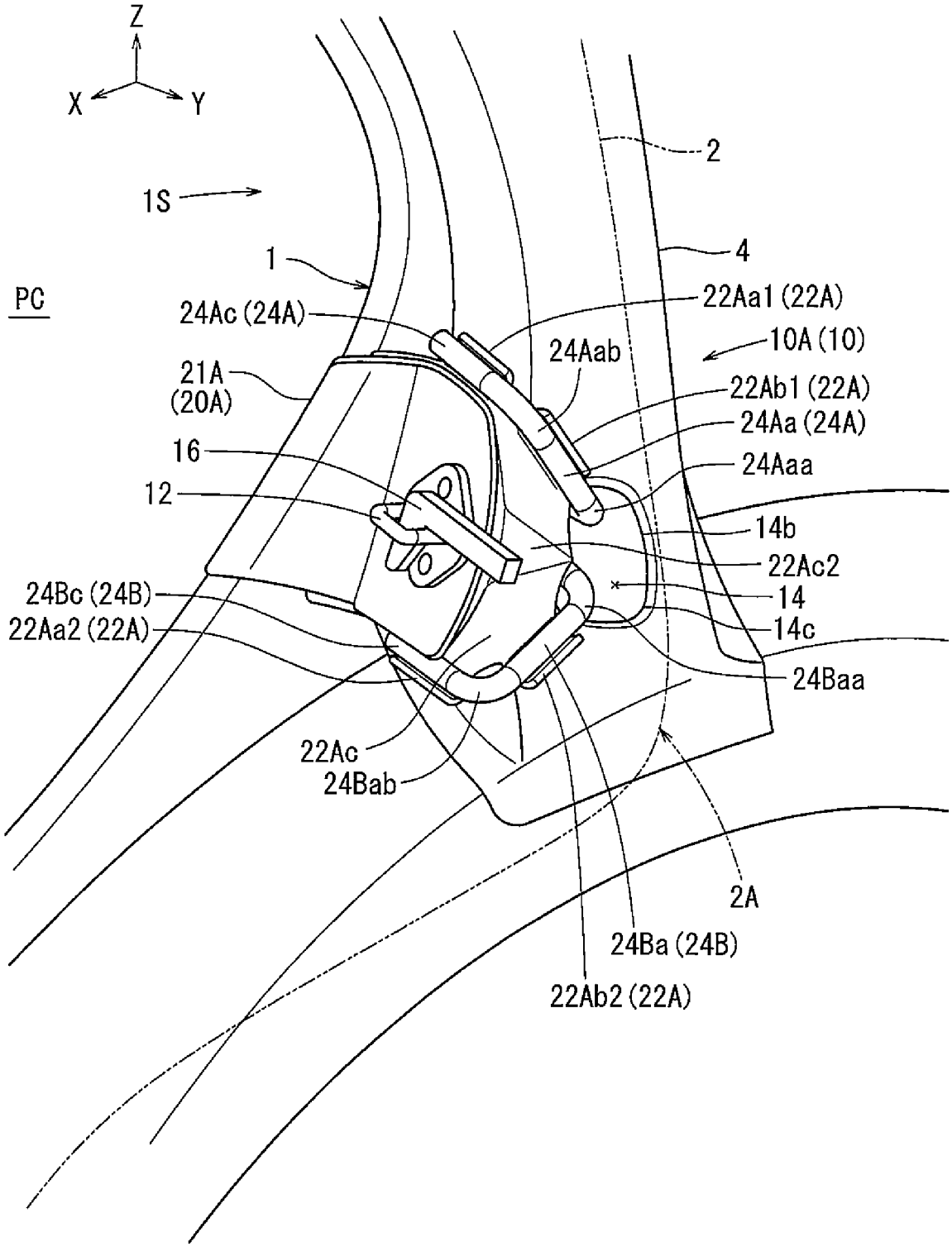
FIG. 1 is a perspective view of an entire striker mounting structure according to a first embodiment.

A strike mounting structure will be described with reference to drawings. The striker mounting structure may include, for example, a striker mounting unit configured to mount a striker on a vehicle body. The X-axis, Y-axis, and Z-axis illustrated in the drawings intersect orthogonally with each other. For the purposes of the following discussions, with reference to the vehicle body 1, an X-direction is set as "forward," a direction opposite to the X-direction as "backward," a Z-direction as "upward," and a direction opposite to the Z-direction as "downward." The Y-direction is set as "left" and a direction opposite to the Y-direction as "right."

Figure 3:
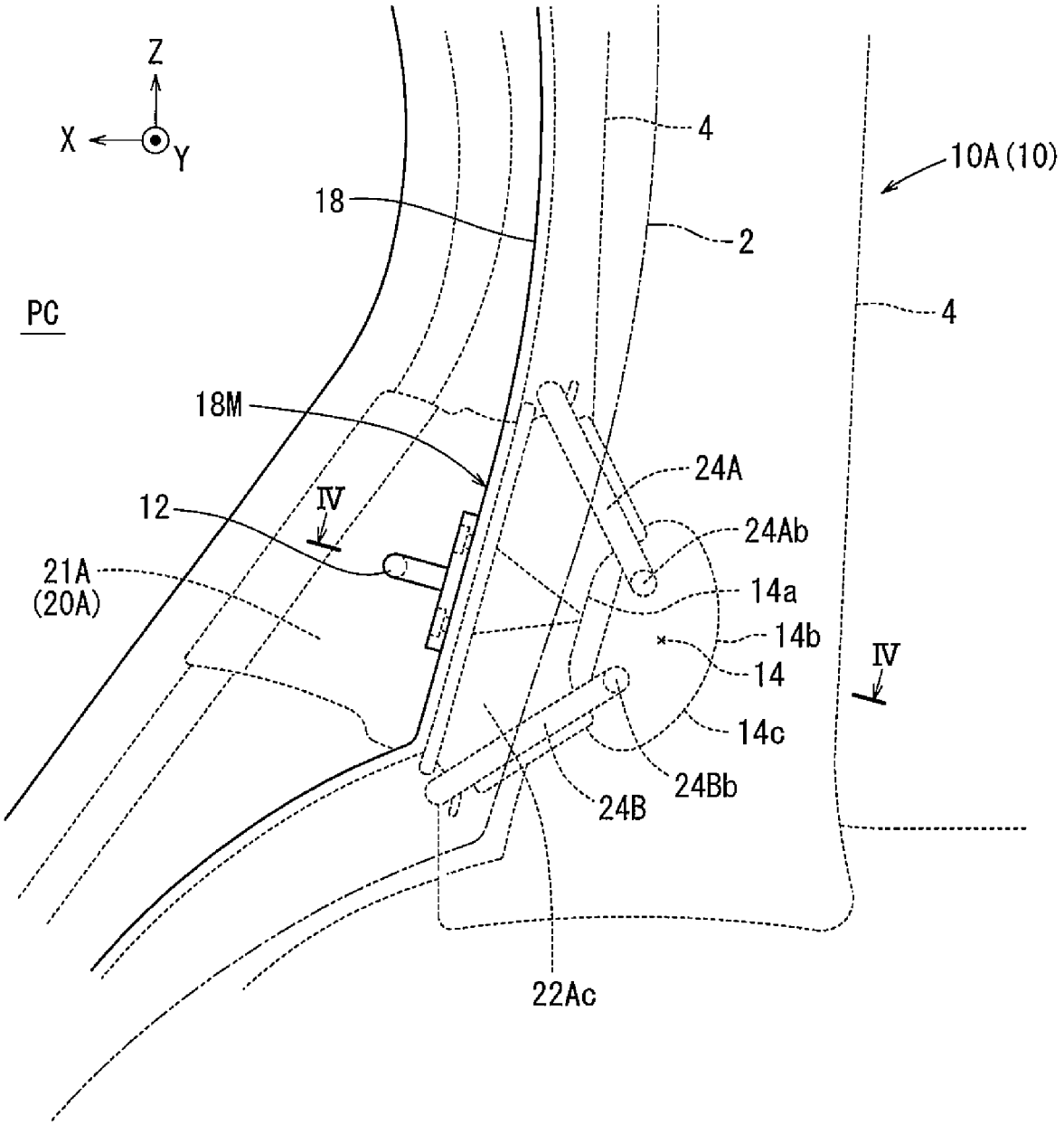
FIG. 3 is an explanatory view illustrating a detailed structure of the striker mounting structure of FIG. 1.

In FIG. 1, an outer panel 18 is not shown. FIG. 1 shows a striker mounting structure for a door 2 provided at a left rear side portion 1S of a vehicle body 1. A reinforcement 4 may be provided at the rear side portion 1S of the vehicle body 1. As shown in FIG. 3, an outer panel 18 may cover the reinforcement 4, a reinforcement member 20A, connecting rods 24A, 24B, and a reinforcement plate 22Ac. As also shown in FIG. 3, a striker 12 may not be covered by the outer panel 18.

A hook 16 may be provided on a door rear end portion 2A of the door 2. When the door 2 is closed, the hook 16 may lock in the striker 12. When the hook 16 is locked in the striker 12, the striker 12 prevents the door 2 from entering the passenger compartment PC in the event of a side collision. The below described striker mounting structure 10A (10) is configured to allow the striker 12 to be mounted on the vehicle body.

Figure 2:
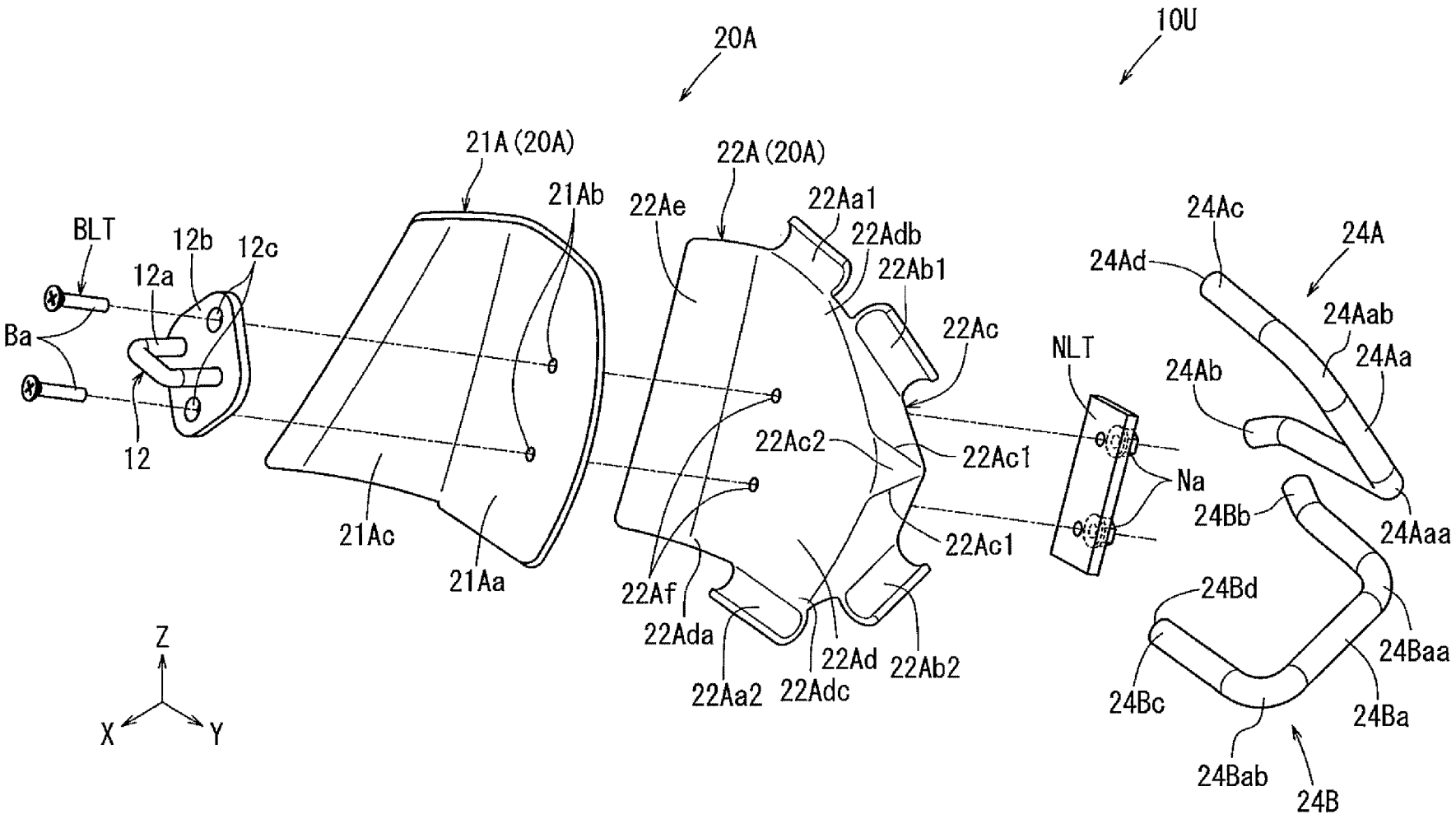
FIG. 2 is an exploded perspective view of the striker mounting unit of FIG. 1.

The striker 12 may be mounted on the vehicle body 1 and be one component of a striker mounting unit 10U. As shown in FIG. 2, the striker mounting unit 10U may include a striker 12, a reinforcement member 20A, connecting rods 24A, 24B, bolts BLT, and a nut plate NLT.

As shown in FIG. 3, the reinforcement 4 may be provided with an insertion hole 14. The insertion hole 14 may open toward a direction away from the passenger compartment PC, which is the direction opposite to the interior of the passenger compartment PC. The outer panel 18 may include a striker mounting surface 18M on the front side thereof. The striker mounting surface 18M may be provided so as to be spaced from the reinforcement 4 in the forward/backward direction of the vehicle body.

As shown in FIG. 2, the reinforcement member 20A may include two reinforcement members 21A, 22A. The striker 12 may be fixed to one of the reinforcement members (reinforcement member 20A in this embodiment). Specifically, the striker 12 may include a striker plate 12*b* disposed on the striker mounting surface 18M (see FIG. 3) and a striker rod 12*a*, which may be substantially U-shaped, projecting from the striker plate 12*b*.

A mounting plate portion 21Aa of the reinforcement member 21A, shown in FIG. 2, may be disposed on the rear side of the striker mounting surface 18M, as shown in FIG. 3. The reinforcement member 22A is disposed on the rear side of the mounting plate portion 21Aa of the other reinforcement member 21A. The nut plate NLT is disposed on the rear side of the reinforcement member 22A. Legs Ba of the bolts BLT are sequentially inserted in holes 12*c* in the striker 12, holes in the striker mounting surface 18M, and each of the holes 21Ab, 22Af in the corresponding reinforcement members 21A, 22A. The front ends of the legs Ba of the bolts BLT are screwed into nuts Na provided on the nut plate NLT. In this way, the striker 12 is fixed on the striker mounting surface 18M, together with the reinforcement member 20A, using the bolts BLT and nut plate NLT.

Referring to FIGS. 1 and 2, the reinforcement member 21A may be formed, for example, in an L-shape in a top view. The reinforcement member 21A may include a mounting plate portion 21Aa and a lateral wall 21Ac rising from one end edge of the mounting plate portion 21Aa. The mounting plate portion 21Aa faces the reinforcement 4, with a gap formed therebetween. The mounting plate portion 21Aa may have a shape which generally follows a corresponding surface of the reinforcement 4. Two holes 21Ab are formed in the mounting plate portion 21Aa, into which the bolts BLT may be inserted. The reinforcement member 22A may be formed in a shape to generally conform to the shape of the reinforcement member 21A. A reinforcement plate 22Ac may be formed at an end of the reinforcement member 22A directed toward the outside of the passenger compartment PC. The reinforcement plate 22Ac may be oriented in the direction away from the passenger compartment PC.

As shown in FIG. 2, the connecting rods 24A, 24B may have a U-shaped configuration. The connecting rods 24A, 24B may respectively include rod portions 24Aa, 24Ba, locking portions 24Ab, 24Bb, and fixing end portions 24Ac, 24Bc. The locking portions 24Ab, 24Bb extend from one end of the corresponding rod portions 24Aa, 24Ba (for example, ends close to each other, specifically, a lower end of the rod portion 24Aa and an upper end of the rod portion 24Ba) in the direction toward the inside of the passenger compartment PC. The fixing end portions 24Ac, 24Bc extend from the other end of the corresponding rod portions 24Aa, 24Ba (for example, ends far from each other, specifically, an upper end of the rod portion 24Aa, a lower end of the rod portion 24Ba) in the direction toward the inside of the passenger compartment PC. The locking portions 24Ab, 24Bb are inserted in the same insertion hole 14 (see FIG. 3) formed in the reinforcement 4. The rod portions 24Aa, 24Ba serve to connect the locking portions 24Ab, 24Bb with the fixing end portions 24Ac, 24Bc.

As shown in FIG. 2, the reinforcement member 22A may have substantially a Z-shape as viewed from the top. The reinforcement member 22A may include a plate-like main body 22Ad, a flange 22Ae, and a reinforcement plate 22Ac. The flange 22Ae extends from an inner edge, which is an edge nearer the passenger compartment PC, of the plate-like main body 22Ad in a direction away from the reinforcement 4 (see FIG. 1), for example, in the forward direction. The flange 22Ae may be positioned along a passenger compartment PC inner side of the lateral wall 21Ac of the reinforcement member 21A. The reinforcement plate 22Ac extends from a passenger compartment PC outer edge of the plate-like main body 22Ad in a direction toward the reinforcement 4, for example, in the backward direction. An end 22Ada of the reinforcement 22A in the direction toward the passenger compartment PC has a flange 22Ae. The first connecting rod 24A is fixed to an upper portion 22Adb of the reinforcement member 22A. The second connecting rod 24B is fixed to an lower portion 22Adc of the reinforcement member 22A.

As shown in FIG. 2, the reinforcement member 22A may include fixing portions 22Aa1, 22Aa2, 22Ab1, and 22Ab2, to which the connecting rods 24A, 24B are configured to be attached. The fixing portions 22Aa1, 22Aa2 may extend from opposite ends of the plate-like main body 22Ad, for example, the upper and lower ends. The fixing portions 22Aa1, 22Aa2 may have, for example, a semicircular bottom surface, which conforms to the shape of the fixing end portions 24Ac, 24Bc of the connecting rods 24A, 24B. The fixing end portions 24Ac, 24Bc of the connecting rods 24A, 24B are welded to the inner peripheral surfaces of the fixing portions 22Aa1, 22Aa2. The fixing portions 22Ab1, 22Ab2 extend from opposite ends of the reinforcement plate 22Ac, for example, upper and lower ends. The fixing end portions 22Ab1, 22Ab2 may have, for example, a semicircular bottom surface, which conforms to the shape of the rod portions 24Aa, 24Ba of the connecting rods 24A, 24B. The rod portions 24Aa, 24Ba of the connecting rods 24A, 24B are welded to the inner peripheral surfaces of the fixing portions 22Ab1, 22Ab2.

As shown in FIGS. 1 and 2, the connecting rods 24A, 24B are attached to the reinforcement member 20A. The locking portions 24Ab, 24Bb of the connecting rods 24A, 24B project from the reinforcement member 20A toward the reinforcement 4. The locking portions 24Ab, 24Bb are inserted into the insertion hole 14 formed in the reinforcement 4. The connecting rods 24A, 24B are arranged vertically in the upward/downward direction with respect to each other. The rod portions 24Aa, 24Ba of the connecting rods 24A, 24B extend in the forward/backward direction. The spacing between the rod portions 24Aa, 24Ba gradually reduces in the backward direction.

As shown in FIG. 2, the reinforcement plate 22Ac may include two ridge lines 22Ac1 extending in the forward/backward direction. The reinforcement plate 22Ac may also include a top portion 22Ac2 formed, for example, to have substantially a triangular shape between the ridge lines 22Ac1. The reinforcement plate 22Ac is raised in the thickness direction, such that the top portion 22Ac2 faces away from the passenger compartment PC. As an alternative to the two ridge lines 22Ac1 and the top portion 22Ac2, only one ridge line 22Ac1 may be provided. The reinforcement plate 22Ac is raised in the thickness direction, such that the ridge lines 22Ac1 are located outside of the passenger compartment PC.

Figure 4:
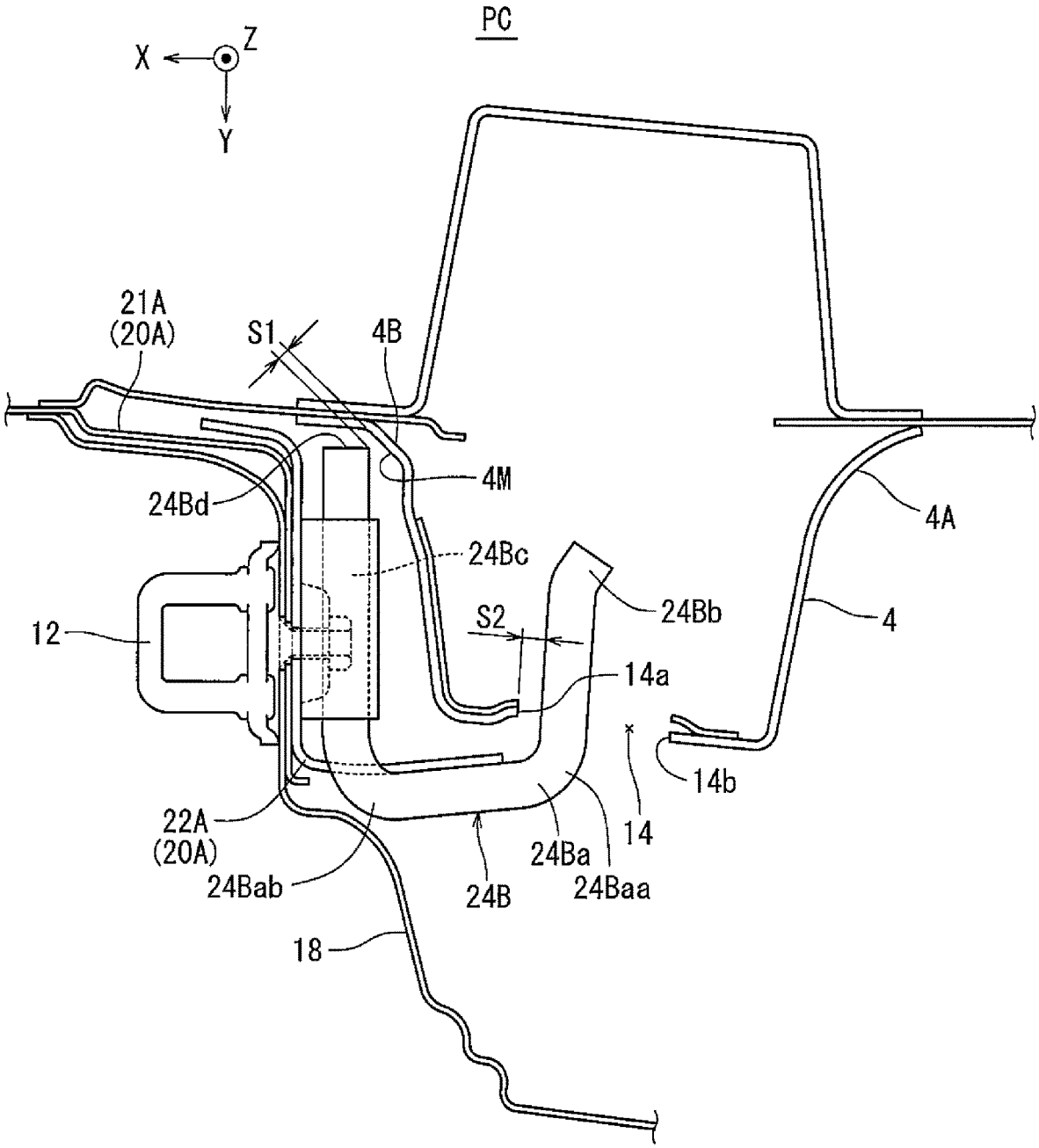
FIG. 4 is a cross-sectional view taken along line IV-IV of FIG. 3.
Figure 5:
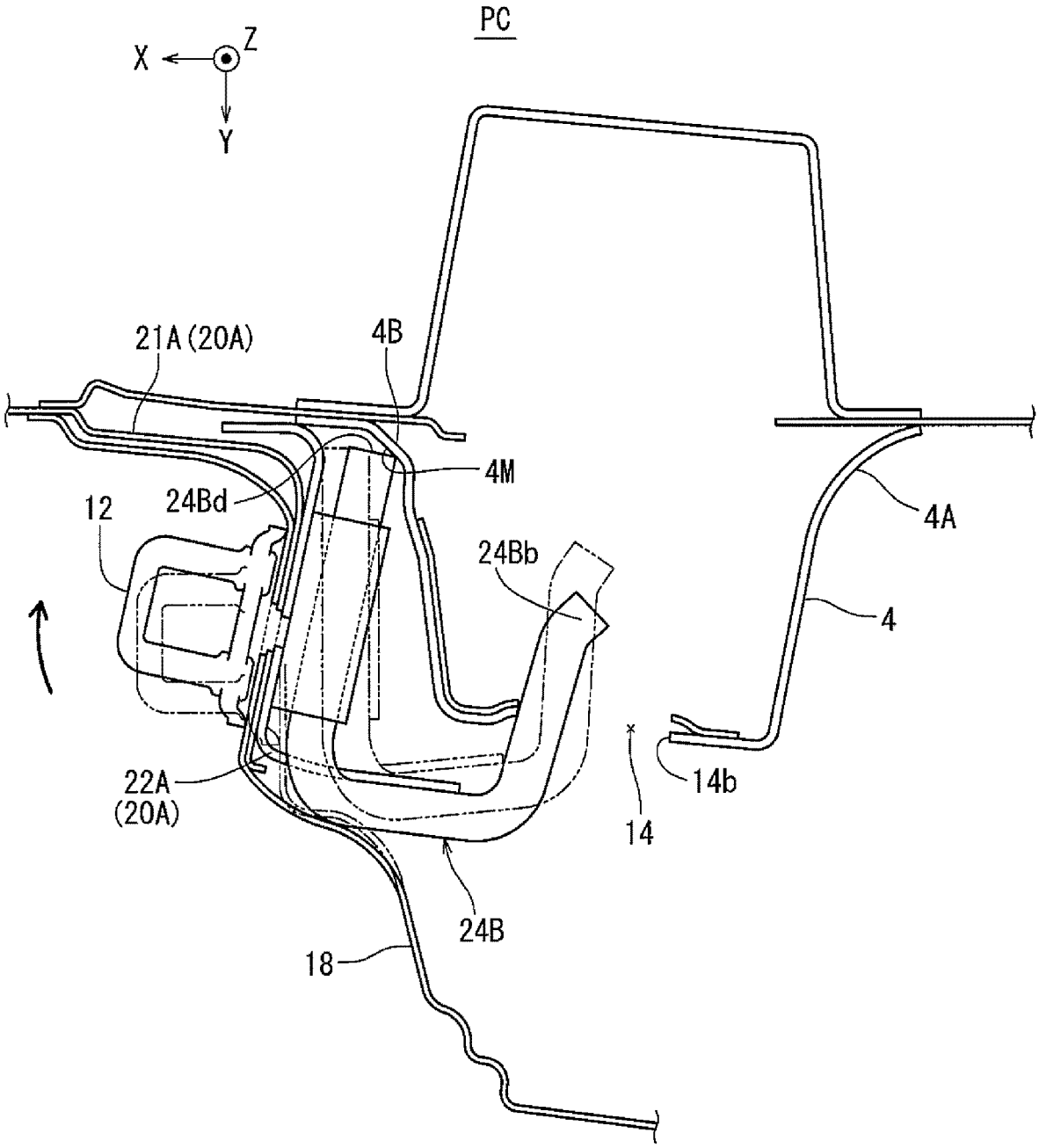
FIG. 5 is an explanatory view illustrating a movement of the striker mounting structure of FIG. 1 in the event of a side collision.

FIGS. 4 and 5 illustrate movement of the striker mounting structure 10A during a side collision. The two-dotted chain lines in FIG. 5 indicate the position of the striker 12 before the side collision; the solid lines indicate the position of the striker 12 during a side collision.

As shown in FIG. 4, the reinforcement 4 may have a U-shaped or a hat-shaped configuration in the X-Y plane. End portions 4A, 4B are provided at each end of the reinforcement 4. The end portions 4A, 4B may have an outwardly opened flange-like configuration and may be fixed to the vehicle body so as to be oriented toward the direction inside the passenger compartment PC. Joining the end portions 4A, 4B with another member allows the strength of the abutment surface 4M of the reinforcement 4, including end portions 4A, 4B, to be enhanced.

As shown in FIG. 4, the connecting rod 24B may include a locking portion 24Bb extending from the rear end of the rod portion 24Ba toward the passenger compartment PC. The locking portion 24Bb is inserted, from the outside, into the insertion hole 14 of the reinforcement 4. The connecting rod 24B includes a fixing end portion 24Bc (corresponding to an abutment portion). The fixing end portion 24Bc extends from the front end of the rod portion 24Ba toward the passenger compartment PC. The fixing end portion 24Bc (corresponding to the abutment portion) includes an abutment front end 24Bd at the front end thereof, the end nearer the inside of the passenger compartment PC. The abutment front end 24Bd faces an abutment surface 4M of the reinforcement 4. The portion of the abutment front end 24Bd nearest the inside of the passenger compartment PC is disposed closer to the passenger compartment PC than the end of the striker 12 nearest the passenger compartment PC. When an impact is applied to the door 2 and the outer panel 18 is deformed, the connecting rod 24B moves such that the abutment front end 24Bd abuts the abutment surface 4M. A connecting rod 24A is configured similar to the connecting rod 24B. Specifically, the connecting rod 24A includes a fixing end portion 24Ac (corresponding to the abutment portion) and an abutment front end 24Ad (corresponding to the end portion of the abutment portion in the direction inside of the passenger compartment PC).

As shown in FIG. 4, a first gap 51 may be formed between the abutment front end 24Bd and the abutment surface 4M. The connecting rod 24B is inserted into the insertion hole 14, so as to cover the front edge of the insertion hole 14. A second gap S2 may be formed between the locking portion 24Bb of the connecting rod 24B and the front edge of the insertion hole 14. The second gap S2 is greater than the first gap 51. The connecting rod 24A is also inserted into the insertion hole 14 in a similar positional relationship as that of the above described connecting rod 24B and the insertion hole 14. In other words, a first gap (not shown) is formed between the abutment front end 24Ad of the connecting rod 24A and the abutment surface 4M. A second gap (not shown) is formed between the locking portion 24Ab of the connecting rod 24A and the front edge of the insertion hole 14.

As shown in FIG. 5, in the event of a side collision, the door rear end portion moves toward the front of the vehicle body when, for example, the door is deformed. As a result, the hook 16 (see FIG. 1) on the door moves forward. As a result, the hook 16 pulls the striker 12 in the forward direction. The movement of the striker 12 causes the entire reinforcement member 20A to move in the forward direction of the vehicle body. As the reinforcement member 20A moves forward, the locking portions 24Ab, 24Bb of the connecting rods 24A, 24B are moved to abut the edges of the insertion hole 14 formed in the reinforcement 4. This abutment with the reinforcement 4 prevents the connecting rods 24A, 24B from further moving in the forward direction. As a result, a reaction force in the backward direction of the vehicle body is applied to the connecting rods 24A, 24B from the reinforcement 4. This, plus the abutment with the insertion hole 14, causes a rotational force to act on the connecting rods 24A, 24B, in particular rotation about the locking portions 24Ab, 24Bb (for instance, in a direction indicated by the arrow in FIG. 5).

As a result, as shown in FIG. 5, the abutment front end 24Bd of the connecting rod 24B moves backward and abuts the abutment surface 4M. The locking portion 24Bb of the connecting rod 24B moves forward and becomes locked at the front edge of the insertion hole 14.

The use of a plurality of connecting rods 24A, 24B prevents the striker 12 from being inclined, for instance in the up or down direction, during the side collision. In contrast, if only one connecting rod is provided, a striker may be inclined/bent during a side collision about the portion where the striker is locked in the insertion hole, for example due to rotation of the connecting rod. The present embodiment, on the other hand, may prevent such a bending movement of the striker 12 with respect to the insertion hole 14 of the reinforcement 4. The hook 16 is therefore prevented from being removed from the striker 12. Accordingly, entry of the door into the passenger compartment PC may be prevented or delayed, as the reinforcement member 21A and the reinforcement 4 are gradually deformed during the side collision. As shown in FIG. 3, the locking portions 24Ab, 24Bb of the first connecting rods 24A, 24B are inserted in the insertion hole 14 nearer to a first end 14*a* of the insertion hole 14 closer to the reinforcement member 21A than to a second end 14*b* of the insertion hole 14 located opposite the first end of the insertion hole 14*a*. The connecting rods 24A, 24B are spaced apart from an opening edge 14*c* of the insertion hole 14. As shown in FIGS. 1 and 5, the locking portions 24Ab, 24Bb extend from first ends 24Aaa, 24Baa of the rod portions 24Aa, 24Ba toward the passenger compartment PC so as to be inserted in the insertion hole 14. The abutment portions 24Ac, 24Bc extend from second ends 24Aab, 24Bab of the rod portions 24Aa, 24Ba toward the passenger compartment PC.

Figure 6:
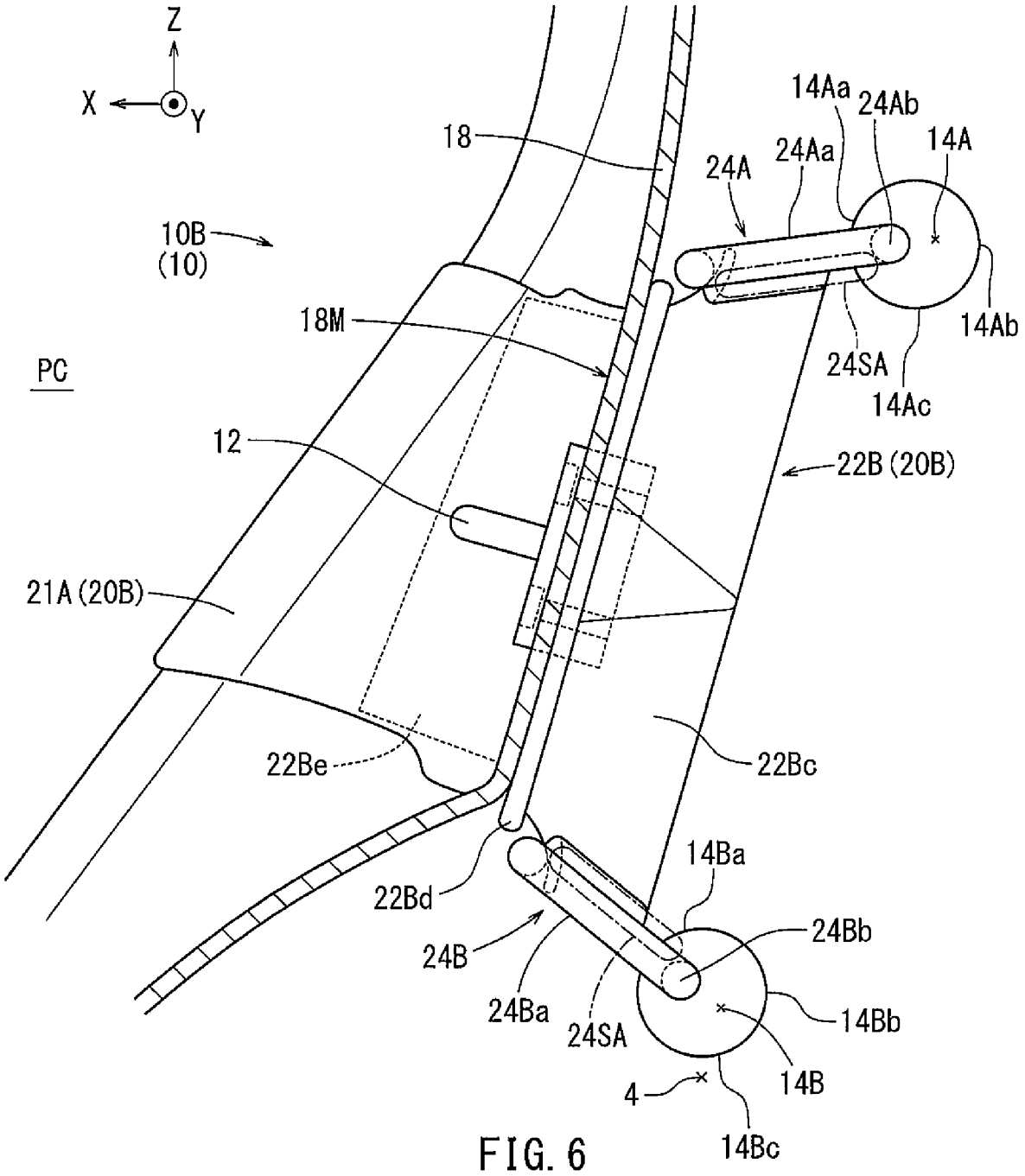
FIG. 6 is an explanatory view of a striker mounting structure according to a second embodiment.

FIG. 6 shows a striker mounting structure 10B (10) according to a second embodiment. The striker mounting structure 10B according to the second embodiment may include a reinforcement member 20B (21A, 22B) alternative to the reinforcement member 20A (21A, 22A) shown in FIGS. 2 and 4. Additionally, the reinforcement 4 may include two insertion holes 14A, 14B, as shown in FIG. 6, in contrast to the one insertion hole 14 shown in FIG. 4.

As shown in FIG. 6, the reinforcement member 22B may have substantially a Z-shaped configuration in the top view. The reinforcement member 22B may also include a plate-like main body 22Bd, a flange 22Be, and a reinforcement plate 22Bc. The flange 22Be extends from the inner edge, closer to the passenger compartment PC, of the plate-like main body 22Bd in a direction away from the reinforcement 4, for example, in the forward direction. The reinforcement plate 22Bc extends from the outer edge, away from the passenger compartment PC, of the plate-like main body 22Bd in a direction toward the reinforcement 4, for example, in the backward direction.

As shown in FIG. 6, two connecting rods 24A, 24B may be attached to the reinforcement member 20B. The rod portion 24Aa of the connecting rod 24A is fixed along the upper edge of the reinforcement plate 22Bc. The rod portion 24Ba of the connecting rod 24B is fixed along the lower edge of the reinforcement plate 22Bc. The interval between the rod portions 24Aa, 24Ba gradually increases toward the backward direction. The locking portions 24Ab, 24Bb extend from the rear ends of the rod portions 24Aa, 24Ba toward the inside of the passenger compartment PC. The locking portions 24Ab, 24Bb are inserted in the insertion holes 14A, 14B of the reinforcement 4, respectively.

As shown in FIG. 6, the locking portions 24Ab, 24Bb may be provided at the rear portions of respective connecting rods 24A, 24B. The first locking portion 24Ab is inserted in the first insertion hole 14A formed in the reinforcement 4. The second locking portion 24Bb is inserted in the second insertion hole 14B formed in the reinforcement 4.

As shown in FIG. 6, the first and second connecting rods 24A, 24B are fixed to an upper portion and a lower portion of the reinforcement plate 22Bc, respectively. The interval between the rod portions 24Aa, 24Ba of the connecting rods 24A, 24B gradually increases toward the backward direction. Alternatively, as shown in FIG. 3, the interval between the rod portions 24Aa, 24Ba may become smaller toward the backward direction. At least one part of the interval changing part 24SA of each of the rod portions 24Aa, 24Ba, where the interval therebetween changes, are fixed to the reinforcement plate 22Bc.

As shown in FIG. 6, in the event of a side collision, the door rear end portion may move in the forward direction when the door is deformed. In this case, the hook 16 (see FIG. 1) formed on the door pulls the reinforcement member 20B in the forward direction via the striker 12. This allows the connecting rod 24A attached to the reinforcement member 20B to move in the forward direction. The locking portion 24Ab of the connecting rod 24A accordingly moves in the forward and downward direction so as to abut a lower front edge of the insertion hole 14A. The other locking portion 24Bb of the other connecting rod 24B accordingly moves in a forward and upward direction so as to abut an upper front edge of the insertion hole 14B. Further, when the door deforms and the hook 16 pulls the striker 12 still further in the forward direction, the reinforcement member 20B and/or the reinforcement 4 is/are gradually deformed.

The reinforcement 4 shown in FIG. 6 may include two insertion holes 14A, 14B. Therefore, the force to be applied to the reinforcement 4 may be dispersed in two spots, as compared with the reinforcement 4 having only one insertion hole 14 as shown in FIG. 3. As a result, the deformation of the reinforcement 4 may be further delayed and the entry of the door in the passenger compartment PC may be prevented or delayed. As shown in FIG. 6, the locking portion 24Ab of the first connecting rod 24A is inserted in the insertion hole 14A nearer to a first end 14Aa of the insertion hole 14A closer to the reinforcement member 21A than to a second end 14Ab of the insertion hole 14A located opposite the first end 14Aa of the insertion hole 14A. The connecting rod 24A is spaced apart from an opening edge 14Ac of the insertion hole 14A. The locking portion 24Bb of the first connecting rod 24B is inserted in the insertion hole 14B nearer to a first end 14Ba of the insertion hole 14B closer to the reinforcement member 21A than to a second end 14Bb of the insertion hole 14B located opposite the first end 14Ba of the insertion hole 14B. The connecting rod 24B is spaced apart from an opening edge 14Bc of the insertion hole 14B.

Figure 7:
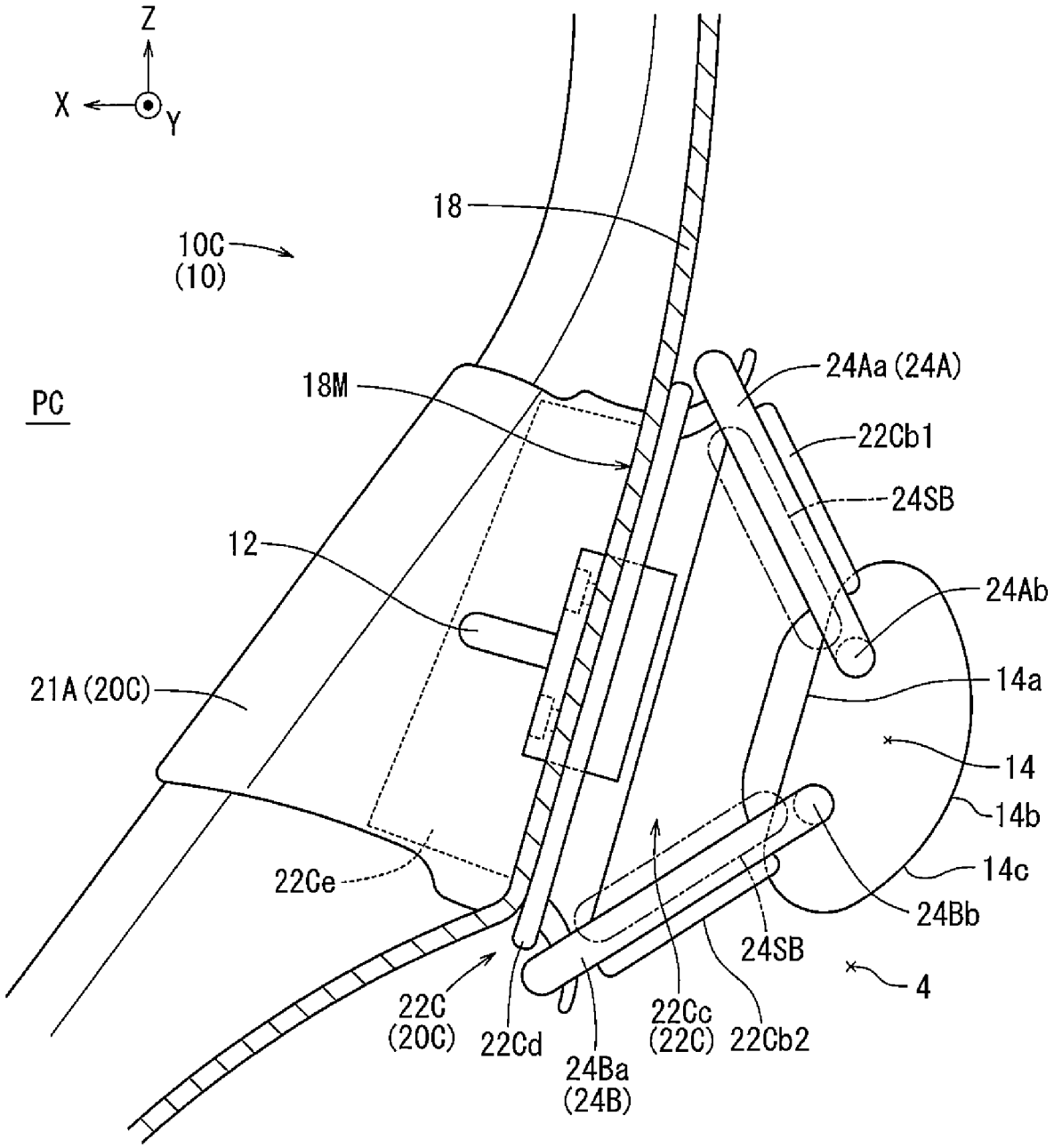
FIG. 7 is an explanatory view of a striker mounting structure according to a third embodiment.

FIG. 7 shows a striker mounting structure 10C (10) according to a third embodiment. The striker mounting structure 10C may include a reinforcement member 20C (21A, 22C), shown in FIG. 7, alternative to the reinforcement members 20A (21A, 22A) shown in FIGS. 2, 3.

As shown in FIG. 7, the reinforcement member 22C may include a plate-like main body 22Cd, a flange 22Ce, and a reinforcement plate 22Cc. The flange 22Ce extends from the inner edge, the edge nearer the passenger compartment PC, of the plate-like main body 22Cd in a direction away from the reinforcement 4, for example, in the forward direction. In this embodiment, the reinforcement plate 22Cc is a separate component from the plate-like main body 22Cd and is attached to the plate-like main body 22Cd. The reinforcement plate 22Cc may extend, for example, from an area near the inner edge, an edge nearer the passenger compartment PC, of the plate-like main body 22Cd in the direction toward the reinforcement 4, for example, in the backward direction.

As shown in FIG. 7, the fixing portions 22Cb1, 22Cb2 are formed at both of the upper and lower ends of the reinforcement plate 22Cc. The fixing portions 22Cb1, 22Cb2 may include, for example, a semicircular bottom surface, which conforms to the shape of the rod portions 24Aa, 24Ba of the connecting rods 24A, 24B. The rod portions 24Aa, 24Ba are welded to the inner peripheral surfaces of the fixing portions 22Cb1, 22Cb2.

As shown in FIG. 7, the connecting rods 24A, 24B are attached to the reinforcement member 20C. The connecting rods 24A, 24B include locking portions 24Ab, 24Bb extending toward the passenger compartment PC from the rod portions 24Aa, 24Ba. The locking portions 24Ab, 24Bb pass into the insertion hole 14. The locking portions 24Ab, 24Bb are aligned in an upward/downward direction. The locking portions 24Ab, 24Bb are configured as fixing end portions or abutment portions, which can each be locked at the hole edge of the insertion hole 14. The width, in the upward/downward direction, of the reinforcement plate 22Cc changes, specifically, the width gradually reduces in the backward direction. In other words, the reinforcement plate 22Cc includes an interval gradually changing part 24SB. The rod portions of the two connecting rods 24A, 24B are fixed, for instance by welding, to the interval gradually changing part 24SB.

As shown in FIG. 7, the rod portion 24Aa of the first connecting rod 24A extends along the upper edge of the reinforcement plate 22Cc in the forward/backward direction. The rod portion 24Ba of the second connecting rod 24B extends along the lower edge of the reinforcement plate 22Cc in the forward/backward direction. The interval between the rod portions 24Aa and 24Ba, generally located at the interval changing portion 24SB, gradually becomes smaller in the backward direction. The locking portions 24Ab, 24Bb extend from the rear ends of the rod portions 24Aa, 24Ba toward the inside of the passenger compartment PC. The locking portions 24Ab, 24Bb are inserted in the insertion hole 14 of the reinforcement 4.

Figure 8:
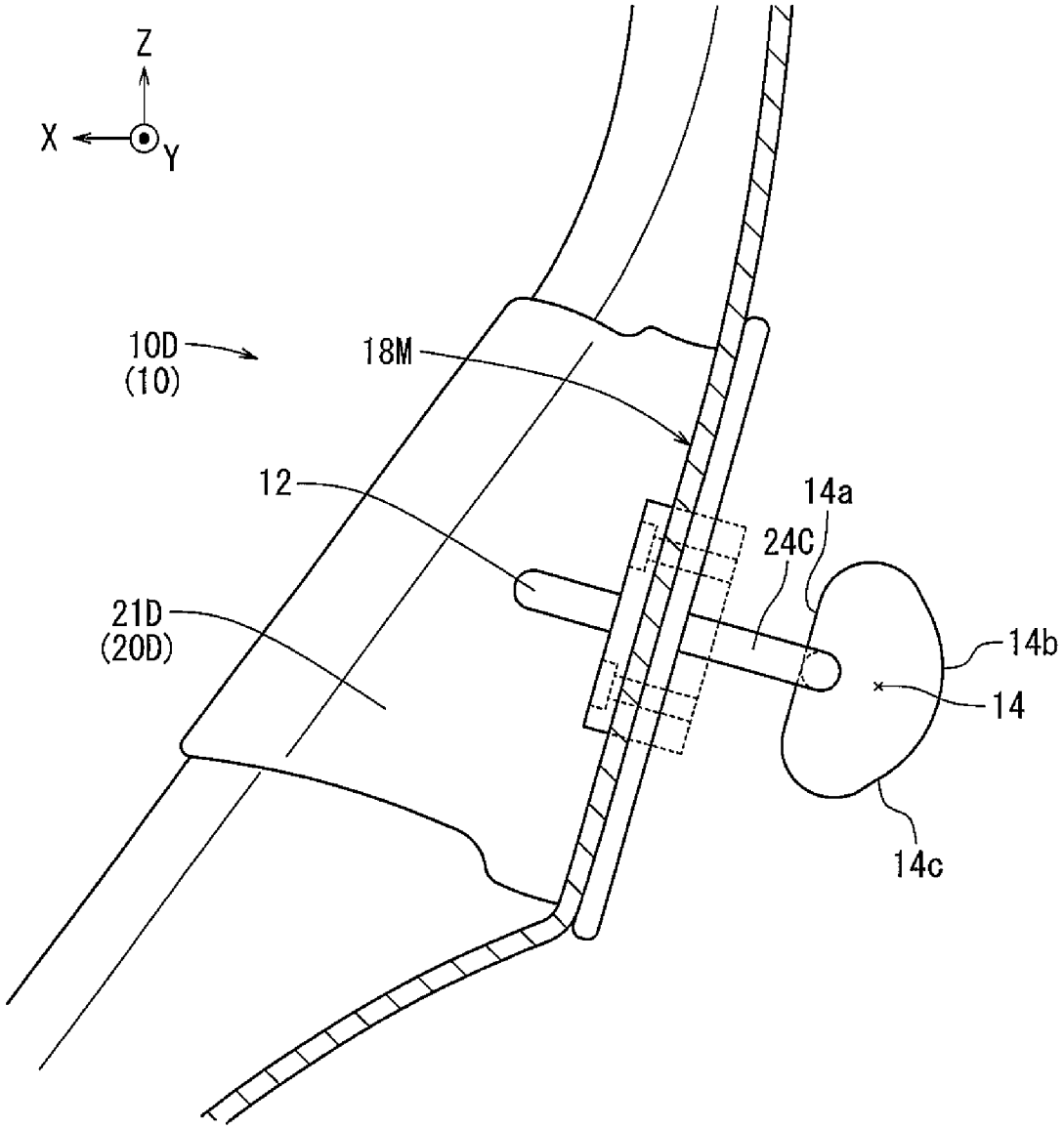
FIG. 8 is an explanatory view of the striker mounting structure according to a fourth embodiment.

FIG. 8 shows a striker mounting structure 10D (10) according to the fourth embodiment. The striker mounting structure 10D according to the fourth embodiment may include a reinforcement member 20D different than the reinforcement member 20A shown in FIG. 2.

As shown in FIG. 8, the reinforcement member 20D may include a reinforcement member 21D different than the reinforcement member 21A shown in FIG. 2. For instance, the reinforcement member 20D of FIG. 8 does not include a reinforcement plate corresponding to the reinforcement plate 22Ac shown in FIG. 2. Additionally, FIG. 8 depicts only one connecting rod 24C attached to the reinforcement member 21D. Specifically, a fixing end portion (corresponding to the abutment portion) of the connecting rod member 24C is fixed to the fixing portion at substantially the center of the rear surface of the reinforcement member 20D, in the upward/downward direction. The connecting rod 24C extends backward from the reinforcement member 21 toward the passenger compartment PC. The locking portion, which is a tip end of the connecting rod 24C, is inserted into the insertion hole 14 formed in the reinforcement 4.

The shapes of the striker 12 and the hook 16 are not limited to those illustrated in FIG. 1, and may have different shapes as long as the hook can be locked by the striker.

The striker mounting structure 10 may include one or two connecting rods 24A, 24B as shown, for example, in FIG. 2. Alternatively, the striker mounting structure 10 may have three or more connecting rods. One end of each of the three connecting rods may be inserted in one insertion hole formed in the reinforcement 4. Alternatively, the one end of each of the three connecting rods may be inserted in a plurality of insertion holes formed in the reinforcement 4.

The reinforcement member 22A illustrated in FIGS. 2, 4 and the reinforcement member 22B illustrated in FIG. 7 may have the plate-like main bodies 22Ad, 22Bd and the reinforcement plates 22Ac, 22Bc integrally formed as a single member. Alternatively, the reinforcement plates 22Ac, 22Bc may be separate components from the plate-like main bodies 22Ad, 22Bd and may be attached to the plate-like main bodies 22Ad, 22Bd.

The various examples described above in detail with reference to the attached drawings are intended to be representative of the present disclosure and are thus non-limiting embodiments. The detailed description is intended to teach a person of skill in the art to make, use, and/or practice various aspects of the present teachings, and thus does not limit the scope of the disclosure in any manner. Furthermore, each of the additional features and teachings disclosed above may be applied and/or used separately or with other features and teachings in any combination thereof, to provide an improved striker mounting structure, and/or methods of making and using the same.

What is claimed is:

1. A striker mounting structure, comprising:

a reinforcement provided on a vehicle body and formed with an insertion hole;

an outer panel for covering the reinforcement, the outer panel having a striker mounting surface arranged to be spaced apart from the reinforcement;

a reinforcement member fixed to the striker mounting surface and to a striker; and a first connecting rod fixed to the reinforcement member, wherein the first connecting rod includes a locking portion inserted in the insertion hole and includes an abutment portion extending along the reinforcement member in a direction toward a passenger compartment, wherein the reinforcement includes an abutment surface facing an end of the abutment portion of the first connecting rod in the direction toward the passenger compartment, wherein the end of the abutment portion is disposed closer to the passenger compartment than an end of the striker closest to the passenger compartment, and wherein the locking portion of the first connecting rod is inserted in the insertion hole nearer to a first end of the insertion hole closer to the reinforcement member than to a second end of the insertion hole located opposite the first end of the insertion hole.

2. The striker mounting structure according to claim 1, wherein:

a hook is provided on a rear end of a vehicle door and is configured to hook the striker, and the striker mounting surface is located in front of the reinforcement.

3. The striker mounting structure according to claim 1, wherein:

the insertion hole opens in a direction away from the passenger compartment, the first connecting rod includes a rod portion extending in a forward/rearward direction of a vehicle, and the locking portion extends from the rod portion in the direction toward the passenger compartment.

4. The striker mounting structure according to claim 1, wherein:

the reinforcement member abuts a rear surface of the striker mounting surface, the rear surface facing the reinforcement, and the striker abuts a front surface of the striker mounting surface, the front surface being opposite to the rear surface.

5. The striker mounting structure according to claim 1, wherein:

the first connecting rod includes a rod portion extending in a forward/backward direction of a vehicle, the locking portion extends from a first end of the rod portion toward the passenger compartment so as to be inserted in the insertion hole, and the abutment portion extends from a second end of the rod portion toward the passenger compartment.

6. The striker mounting structure according to claim 1, wherein:

an end of the reinforcement in the direction toward the passenger compartment has a flange, the reinforcement has a cross-sectional configuration in a plateau-shape, and the end includes the abutment surface.

7. The striker mounting structure according to claim 1, wherein:

the first connecting rod is fixed to an upper portion of the reinforcement member, a second connecting rod is fixed to an lower portion of the reinforcement member, and an interval between the first and second connecting rods increases or reduces in a backward direction.

8. The striker mounting structure according to claim 1, further comprising a reinforcement plate extending from the reinforcement member toward the reinforcement.

9. The striker mounting structure according to claim 8, wherein the first connecting rod is fixed to the reinforcement plate.

10. The striker mounting structure according to claim 9, wherein:

the first connecting rod extends along an upper end of the reinforcement plate, a second connecting rod extends along a lower end of the reinforcement plate and is fixed to the reinforcement plate, and an interval between the first and second connecting rods increases or reduces in a backward direction.

11. The striker mounting structure according to claim 8, wherein the reinforcement plate is a separate component from the reinforcement member, and the reinforcement plate is attached to the reinforcement member.

12. The striker mounting structure according to claim 8, wherein the reinforcement plate includes a ridge line extending in a forward/backward direction so as to form a convex shape a direction away from the passenger compartment or in the direction toward the passenger compartment.

13. The striker mounting structure according to claim 1, wherein a first gap between the end of the abutment portion and the reinforcement is smaller than a second gap between the locking portion of the first connecting rod and the reinforcement.

14. A striker mounting structure, comprising:

a reinforcement provided on a vehicle body and formed with an insertion hole;

an outer panel for covering the reinforcement, the outer panel having a striker mounting surface arranged to be spaced apart from the reinforcement;

a reinforcement member fixed to the striker mounting surface and to a striker; and a connecting rod fixed to the reinforcement member, wherein the connecting rod includes a locking portion inserted in the insertion hole and includes an abutment portion extending along the reinforcement member in a direction toward a passenger compartment, wherein a distance between an end of the abutment portion nearest the passenger compartment and the passenger compartment is smaller than a distance between the striker and the passenger compartment.

15. The striker mounting structure according to claim 14, wherein the striker comprises:

a striker plate; and a striker rod projecting from the striker plate.

16. The striker mounting structure according to claim 15, wherein the abutment portion of the connecting rod is disposed between the striker plate and reinforcement in a direction perpendicular to the direction toward the passenger compartment.

17. The striker mounting structure according to claim 15, wherein the distance between the end of the abutment portion nearest the passenger compartment and the passenger compartment is smaller than a distance between the striker plate and the passenger compartment.

18. The striker mounting structure according to claim 15, wherein the end of the abutment portion nearest the passenger compartment is closer to the reinforcement than to the striker plate.

19. The striker mounting structure according to claim 14, wherein the connecting rod is spaced apart from an opening edge of the insertion hole.

20. The striker mounting structure according to claim 14, wherein the connecting rod does not directly contact the reinforcement.

* * * * *